US010937375B2

(12) United States Patent
Xiao

(10) Patent No.: US 10,937,375 B2
(45) Date of Patent: Mar. 2, 2021

(54) LIQUID CRYSTAL DISPLAY PANEL AND LIQUID CRYSTAL DISPLAY DEVICE HAVING THE LIQUID CRYSTAL DISPLAY PANEL

(71) Applicant: SHENZHEN CHINA STAR OPTOELECTRONICS TECHNOLOGY CO., LTD., Guangdong (CN)

(72) Inventor: Guangxing Xiao, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 311 days.

(21) Appl. No.: 16/304,018

(22) PCT Filed: Sep. 18, 2018

(86) PCT No.: PCT/CN2018/106186
§ 371 (c)(1),
(2) Date: Nov. 21, 2018

(87) PCT Pub. No.: WO2020/042244
PCT Pub. Date: Mar. 5, 2020

(65) Prior Publication Data

US 2020/0365096 A1 Nov. 19, 2020

(30) Foreign Application Priority Data

Aug. 31, 2018 (CN) ..... 201811010301.7

(51) Int. Cl.
*G09G 3/36* (2006.01)

(52) U.S. Cl.
CPC ..... *G09G 3/36* (2013.01); *G09G 2310/0232* (2013.01); *G09G 2310/08* (2013.01); *G09G 2340/02* (2013.01); *G09G 2370/00* (2013.01)

(58) Field of Classification Search
CPC ..... G09G 2310/08; G09G 2310/0232; G09G 2360/04; G09G 3/36
See application file for complete search history.

(56) References Cited

U.S. PATENT DOCUMENTS 9,997,096 B2 * 6/2018 Shin ..... G09G 3/3666
2009/0147004 A1 * 6/2009 Ramon ..... G06T 3/40 345/428

(Continued)

FOREIGN PATENT DOCUMENTS

CN 101097699 A 1/2008
CN 101527802 A 9/2009

(Continued)

OTHER PUBLICATIONS

Office Action dated Nov. 6, 2019 from corresponding application No. CN 201811010301.7.

*Primary Examiner* — Priyank J Shah
(74) *Attorney, Agent, or Firm* — Leong C. Lei

(57) ABSTRACT

Disclosed is a liquid crystal display panel, including a non-display area and a display area, wherein the non-display area is provided with a system on chip, and the display area includes at least two display sub-areas, and each display sub-area is provided with a corresponding timing controller; the system on chip is electrically connected to each timing controller, and sends edge video data displayed in an edge area of an adjacent display sub-area to each timing controller, and the timing controller receives and processes the edge video data; the adjacent display sub-area is a display sub-area next to the display sub-area corresponding to the timing controller The timing controller can acquire and process the (Continued)

edge video data displayed in the edge area of the adjacent display sub-area, so that the image processing algorithms have better processing effects on the images at the boundary of the display sub-areas.

16 Claims, 3 Drawing Sheets

(56) References Cited

U.S. PATENT DOCUMENTS

2011/0122143 A1* 5/2011 Kegasawa ..... G06F 3/1446 345/581
2015/0325164 A1* 11/2015 Kim ..... G09G 3/3648 345/694
2015/0339967 A1* 11/2015 Shin ..... G09G 3/3406 345/690
2016/0125845 A1 5/2016 Oh
2017/0207240 A1* 7/2017 He ..... H01L 27/124
2018/0293932 A1* 10/2018 Duan ..... G09G 3/3611
2018/0336864 A1* 11/2018 Wang ..... G09G 5/006
2019/0147792 A1* 5/2019 Kim ..... G09G 3/2096 345/694

FOREIGN PATENT DOCUMENTS

CN 101667389 A 3/2010
CN 103824550 A 5/2014
CN 105487313 A 4/2016
CN 105654883 A 6/2016
CN 105867867 A 8/2016
CN 106409249 A 2/2017
CN 106415697 A 2/2017
CN 107633795 A 1/2018
CN 107665658 A 2/2018
CN 107665666 A 2/2018
JP 2014032314 A 2/2014

* cited by examiner

LIQUID CRYSTAL DISPLAY PANEL AND LIQUID CRYSTAL DISPLAY DEVICE HAVING THE LIQUID CRYSTAL DISPLAY PANEL

CROSS REFERENCE

This application is a National Phase of International Application Number PCT/CN2018/106186, filed Sep. 18, 2018, and claims the priority of Chinese Patent Application No. 201811010301.7, entitled "Liquid crystal display panel and liquid crystal display device having the liquid crystal display panel", filed on Aug. 31, 2018, the disclosure of which is incorporated herein by reference in its entirety.

FIELD OF THE INVENTION

The present invention relates to a display field, and more particularly to a liquid crystal display panel and a liquid crystal display device having the liquid crystal display panel.

BACKGROUND OF THE INVENTION

Liquid crystal displays (LCDs) have the advantages of being thin and light, energy-saving, and radiation indicators generally lower than the cathode ray tube (CRT) display, thus making LCDs gradually replace CRT displays in a wide range of applications for various electronic products (such as, mobile phones, tablets, computers and etc.).

For better ensuring the display effect of the liquid crystal display panel, a plurality of timing controllers are usually arranged to work simultaneously in the liquid crystal display panel, and each timing controller correspondingly controls a corresponding area. Namely, each timing controller can only acquire and process data (such as video data) in the corresponding area. However, at the boundary of the aforesaid areas, the image processing algorithms (such as color shift compensation algorithm, visual compensation algorithm, etc.) in the timing controller of the liquid crystal display panel are not ideal for image processing, thus resulting in that the display effect of the liquid crystal display panel cannot meet the viewing requirements.

SUMMARY OF THE INVENTION

The embodiment of the present invention provides a liquid crystal display panel and a liquid crystal display device having the liquid crystal display panel. A timing controller configured in a display sub-area of the liquid crystal display panel can acquire and process edge video data displayed in an edge area of an adjacent display sub-area, so that image processing algorithms have better processing effects on images at a boundary of the display sub-areas.

The embodiment of the present invention provides a liquid crystal display panel, comprising a non-display area and a display area, wherein the non-display area is disposed around a periphery of the display area; wherein the non-display area is provided with a system on chip, and the display area comprises at least two display sub-areas, and each of the display sub-areas is provided with a corresponding timing controller, and any two of the timing controllers are electrically connected; the system on chip is electrically connected to each of the timing controllers, and sends edge video data displayed in an edge area of an adjacent display sub-area to each of the timing controllers, and the timing controller receives and processes the edge video data; wherein the adjacent display sub-area is a display sub-area next to the display sub-area corresponding to the timing controller, and the edge area of the adjacent display sub-area is a partial area of the adjacent display sub-area next to the display sub-area corresponding to the timing controller.

The display area at least comprises a first display sub-area and a second display sub-area, and the first display sub-area is provided with a first timing controller, and the second display sub-area is provided with a second timing controller; wherein the first display sub-area is disposed next to the second display sub-area, and the system on chip is electrically connected to the first timing controller and the second timing controller.

A frame period of the liquid crystal display panel comprises a vertical active video interval and a vertical blanking interval, wherein the vertical active video interval is a scanning time between a time point when an electron gun starts scanning a frame of image and a time point when the electron gun accomplishes scanning the frame of image, and the vertical blanking interval is a preparation time between the time point when the electron gun accomplishes scanning the frame of image and a time point when the electron gun starts scanning a next frame of image; the system on chip transmits the edge video data to the timing controllers via a V-by-one interface in the vertical blanking interval.

The system on chip comprises a data reading circuit, a data recombining circuit and a data transmitting circuit; the data reading circuit reads the edge video data stored in the system on chip; the data recombining circuit is electrically connected to the data reading circuit, and recombines the edge video data read by the data reading circuit to obtain recombined edge video data, and the recombined edge video data possesses a data format required by the V-by-one interface; and the data transmitting circuit is electrically connected to the data recombining circuit, and transmits the recombined edge video data to the timing controller via the V-by-one interface.

The timing controller comprises a data receiving circuit, a data decoding circuit, a data importing circuit and an importing algorithm circuit; the data receiving circuit is configured to receive the recombined edge video data transmitted by the system on chip via the V-by-one interface; the data decoding circuit is electrically connected to the data receiving circuit, and decodes the recombined edge video data received by the data receiving circuit to obtain decoded edge video data, and the decoded edge video data possesses a data format required by the timing controller; the data importing circuit is electrically connected to the data decoding circuit, and transmits the decoded edge video data to the importing algorithm circuit; and the importing algorithm circuit is electrically connected to the data importing circuit, and receives the decoded edge video data transmitted by the data importing circuit, and processes the decoded edge video data according to a preset image processing algorithm.

The preset image processing algorithm comprises a color shift compensation algorithm and/or a visual compensation algorithm.

The system on chip further transmits entire video data displayed in the display sub-area corresponding to the timing controller to each of the timing controllers, and the timing controller further receives and processes the entire video data.

The system on chip transmits the entire video data to the timing controller through the V-by-one interface in the vertical active video interval.

The vertical blanking interval comprises a vertical front porch, a vertical synchronization interval and a vertical back porch; wherein the vertical synchronization interval is a duration of a vertical synchronization signal, and the vertical synchronization signal controls the electron gun to scan the next frame of image, and the vertical front porch is a time between the time point when the electron gun accomplishes scanning the frame of image and a time point of starting the vertical synchronization signal, and the vertical back porch is a time between a time point of finishing the vertical synchronization signal to the time point when the electron gun starts scanning the next frame of image.

Correspondingly, the embodiment of the present invention further provides a liquid crystal display device, including the aforesaid liquid crystal display panel.

In conclusion, in the liquid crystal display panel provided by the embodiment of the invention and the liquid crystal display device having the liquid crystal display panel, the system on chip transmits the edge video data displayed in the edge area of the adjacent display sub-area to the timing controller, the timing controller can acquire and process the edge video data displayed in the edge area of the adjacent display sub-area, so that the image processing algorithms have better processing effects on the images at the boundary of the display sub-areas.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 1:
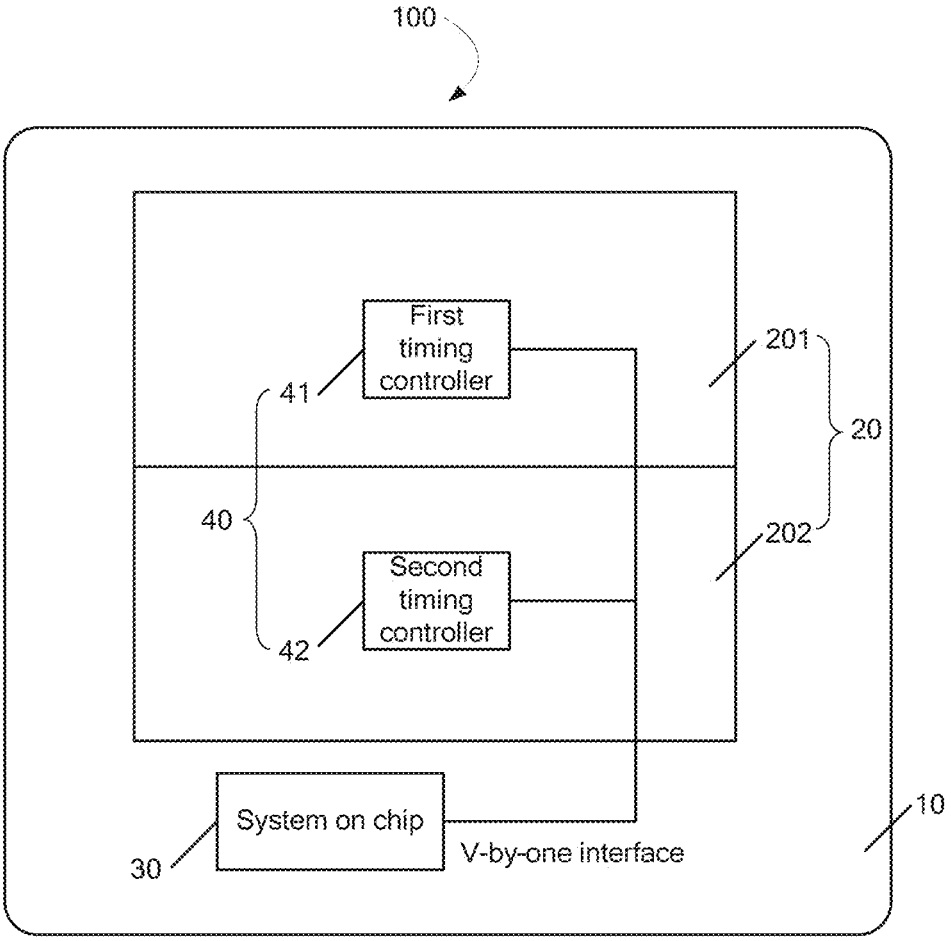
FIG. 1 is a circuit structure diagram of a liquid crystal display panel according to the embodiment of the present invention.

For better explaining the technical solution and the effect of the present invention, the present invention will be further described in detail with the accompanying drawings in the specific embodiments. It is clear that the described embodiments are part of embodiments of the present application, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, et cetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

The embodiment of the present invention provides a liquid crystal display panel. The timing controller configured in the display sub-area of the liquid crystal display panel can acquire and process the edge video data displayed in the edge area of the adjacent display sub-area, so that the image processing algorithms have better processing effects on the images at the boundary of the display sub-areas. A liquid crystal display panel and a liquid crystal display device having the liquid crystal display panel provided by the embodiment of the present invention will be specifically described in the following with reference with FIG. 1 to FIG. 4.

Please refer to FIG. 1. FIG. 1 is a circuit structure diagram of a liquid crystal display panel according to the embodiment of the present invention. As shown in FIG. 1, the liquid crystal display panel 100 includes a non-display area 10 and a display area 20, wherein the non-display area 10 is located at an edge position of the liquid crystal display panel 100 and is disposed around a periphery of the display area 20. Namely, the display area 20 is located inside the non-display area 10. The non-display area 10 is provided with a system on chip (SoC) 30, and the display area 20 is provided with a timing controller (Tcon) 40. The timing controller 40 is electrically connected to system on chip 30. Specifically, the display area 20 includes at least two display sub-areas, and each of the display sub-areas is provided with a corresponding timing controller 40. Any two of the timing controllers 40 are electrically connected.

In the embodiment of the present invention, the system on chip 30 sends video data to each of the timing controllers 40. The timing controller 40 receives and processes the edge video data The video data include an entire video data displayed in the display sub-area corresponding to the timing controller 40 and edge video data displayed in the edge area of the adjacent display sub-area. The adjacent display sub-area is a display sub-area next to the display sub-area corresponding to the timing controller 40, and the edge area of the adjacent display sub-area is a partial area of the adjacent display sub-area next to the display sub-area corresponding to the timing controller 40.

Specifically, in the embodiment of the present invention, the interaction process of the system on chip 30 and the timing controller 40 is schematically illustrated in a condition that the display area 20 includes two display sub-areas.

As shown in FIG. 1, the display area 20 comprises a first display sub-area 201 and a second display sub-area 202, and the first display sub-area 201 is provided with a first timing controller 41, and the second display sub-area 202 is provided with a second timing controller 42. Specifically, the first display sub-area 201 is disposed next to the second display sub-area 202. Namely, the first display sub-area 201 and the second display sub-area 202 are adjacent display sub-areas for each other. The system on chip 30 is electrically connected to the first timing controller 41 and the second timing controller 42. The first timing controller 41 is electrically connected to the second timing controller 42.

In the liquid crystal display panel 100 shown in FIG. 1, the system on chip 30 respectively transmits first video data and second video data to the first timing controller 41 and the second timing controller 42. The first timing controller 41 is configured to receive and process the first video data, and the second timing controller 42 is configured to receive and process the second video data.

The first video data includes the entire video data displayed in the first display sub-area 201 and the edge video data displayed in the edge area of the second display sub-area 202; the second video data includes the entire video data displayed in the second display sub-area 202 and the edge video data displayed in the edge area of the first display sub-area 201.

Figure 2:
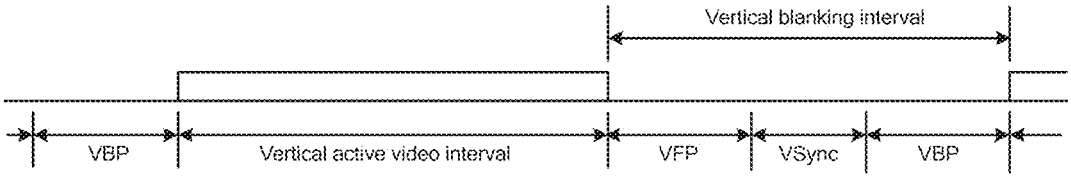
FIG. 2 is a timing chart of video transmission performed by the liquid crystal display panel shown in FIG. 1.

Please refer to FIG. 2. FIG. 2 is a timing chart of video transmission performed by the liquid crystal display panel shown in FIG. 1. In the video image display process of the liquid crystal display panel 100, the video image is formed by switching one frame of image and one frame of image displayed on the liquid crystal display panel 100. As shown in FIG. 2, a frame period of the liquid crystal display panel 100 includes a vertical active video interval and a vertical blanking (VBlank) interval. The vertical active video interval is a scanning time between a time point when an electron gun starts scanning a frame of image and a time point when the electron gun accomplishes scanning the frame of image, and the vertical blanking interval is a preparation time between the time point when the electron gun accomplishes scanning the frame of image and a time point when the electron gun starts scanning a next frame of image.

The vertical blanking interval comprises a vertical front porch (VFP), a vertical synchronization (VSync) interval and a vertical back porch (VBP). The vertical synchronization interval is a duration of a vertical synchronization signal, and the vertical synchronization signal controls the electron gun to scan the next frame of image; the vertical front porch is a time between the time point when the electron gun accomplishes scanning the frame of image and a time point of starting the vertical synchronization signal; the vertical back porch is a time between a time point of finishing the vertical synchronization signal to the time point when the electron gun starts scanning the next frame of image.

Specifically, in the embodiment of the present invention, the system on chip 30 transmits the entire video data displayed in the first display sub-area 201 to the timing controller 41 through the V-by-one interface in the vertical active video interval. The system on chip 30 transmits the entire video data displayed in the second display sub-area 202 to the second timing controller 42 through the V-by-one interface in the vertical active video interval.

Besides, the system on chip 30 transmits the edge video data displayed in the edge area of the second display sub-area 202 to the timing controller 41 through the V-by-one interface in the vertical blanking interval. The system on chip 30 transmits the edge video data displayed in the edge area of the first display sub-area 201 to the second timing controller 42 through the V-by-one interface in the vertical blanking interval. The V-by-One interface is a digital interface standard developed for image transmission, and the input and output levels of signals are Low-Voltage Differential Signaling (LVDS).

Figure 3:
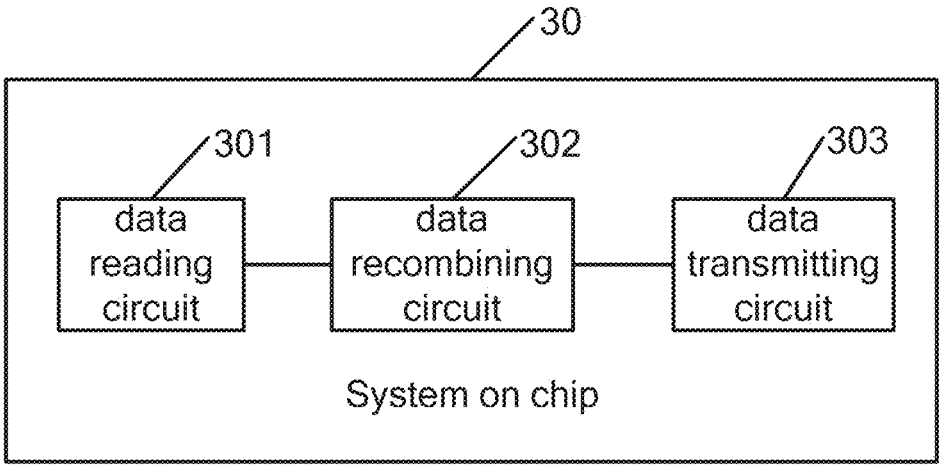
FIG. 3 is a block diagram of the system on chip shown in FIG. 1.

Please refer to FIG. 3. FIG. 3 is a block diagram of the system on chip shown in FIG. 1. As shown in FIG. 3, the system on chip 30 includes a data reading circuit 301, a data recombining circuit 302 and a data transmitting circuit 303.

The data reading circuit 301 is configured to read the edge video data stored in the system on chip 30. Specifically, the edge video data may be stored in a memory of the system on chip 30, and the memory may be a Double Data Rate Synchronous Dynamic Random Access Memory (DDR SDRAM), such as a second generation double rate synchronous dynamic random access memory (DDR2 SDRAM) or a third generation dual Double rate synchronous dynamic random access memory (DDR3 SDRAM).

In the embodiment of the present invention, the edge video data includes the edge video data displayed in the edge area of the first display sub-area 201 and the edge video data displayed in the edge area of the second display sub-area 202.

The data recombining circuit 302 is electrically connected to the data reading circuit 301, and is configured to recombine the edge video data read by the data reading circuit 301 to obtain recombined edge video data. The recombined edge video data possesses a data format required by the V-by-one interface, so that the recombined edge video data can be transmitted via the V-by-one interface.

Specifically, in the embodiment of the present invention, the data recombining circuit 302 recombines the edge video data displayed in the edge area of the first display sub-area 201 to obtain recombined edge video data displayed in the edge area of the first display sub-area 201; the data recombining circuit 302 also recombines the edge video data displayed in the edge area of the second display sub-area 202 to obtain recombined edge video data displayed in the edge area of the second display sub-area 202.

The data transmitting circuit 303 is electrically connected to the data recombining circuit 302, and transmits the recombined edge video data to the timing controller 40 via the V-by-one interface. Specifically, the data transmitting circuit 303 transmits the recombined edge video data displayed in the edge area of any display sub-area to the timing controller 40 corresponding to the adjacent display sub-areas via the V-by-one interface.

In the embodiment of the present invention, the data transmitting circuit 303 transmits the recombined edge video data displayed in the edge area of the second display sub-area 202 to the first timing controller 41 via the V-by-one interface; the data transmitting circuit 303 transmits the recombined edge video data displayed in the edge area of the first display sub-area 201 to the second timing controller 42 via the V-by-one interface.

Figure 4:
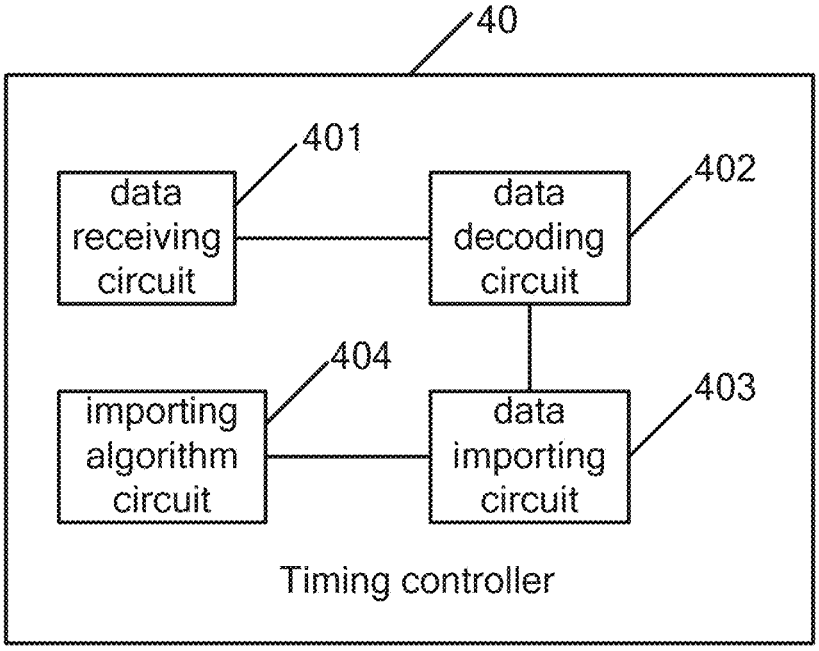
FIG. 4 is a block diagram of the timing controller shown in FIG. 1.

Please refer to FIG. 4. FIG. 4 is a block diagram of the timing controller shown in FIG. 1. As shown in FIG. 4, the timing controller 40 includes a data receiving circuit 401, a data decoding circuit 402, a data importing circuit 403 and an importing algorithm circuit 404.

The data receiving circuit 401 is configured to receive the recombined edge video data transmitted by the system on chip 30 via the V-by-one interface. The recombined edge video data includes the edge video data displayed in the edge area of the adjacent display sub-area.

The data decoding circuit 402 is electrically connected to the data receiving circuit 401, and decodes the recombined edge video data received by the data receiving circuit 401 to obtain decoded edge video data. The decoded edge video data possesses a data format required by the timing controller 40.

The data importing circuit 403 is electrically connected to the data decoding circuit 402, and transmits the decoded edge video data to the importing algorithm circuit 404.

The importing algorithm circuit 404 is electrically connected to the data importing circuit 403, and receives the decoded edge video data transmitted by the data importing circuit 403, and processes the decoded edge video data according to a preset image processing algorithm.

The preset image processing algorithm may include a color shift compensation algorithm, a visual compensation algorithm and etc.

Correspondingly, the embodiment of the present invention further provides a liquid crystal display device, including the aforesaid liquid crystal display panel 100 shown in FIG. 1. For example, the liquid crystal display device 100 may include, but not limited to a mobile phone with a liquid crystal display panel (such as an Android mobile phone, an iOS mobile phone, etc.), a tablet computer, a mobile internet device (MID), a personal digital assistant (FDA), a laptop, a TV set, an electronic paper, a digital photo frame and etc.

In the prior art, each of the timing controller can only acquire and process the video data displayed in the display sub-area corresponding thereto, thus the processing effects of the image processing algorithms on the images at the boundary of the display sub-areas are not ideal. However, in the aforesaid embodiment of the present invention, the timing controller 40 of the liquid crystal display panel 100 can not only acquire and process the entire video data displayed in the display sub-area corresponding thereto, but also acquire and process the edge video data displayed in the edge area of the adjacent display sub-area. The video data displayed at the boundary of the display sub-areas may be shared among the plurality of display sub-areas, such that the image processing algorithms have better processing effects on the images at the boundary of the display sub-areas.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

The detail description has been introduced above for the liquid crystal display panel and the display device having the liquid crystal display panel which are provided by the embodiment of the invention. Herein, a specific case is applied in this article for explain the principles and specific embodiments of the present invention have been set forth. The description of the aforesaid embodiments is only used to help understand the method of the present invention and the core idea thereof; meanwhile, for those of ordinary skill in the art, according to the idea of the present invention, there should be changes either in the specific embodiments and applications but in sum, the contents of the specification should not be limitation to the present invention.

What is claimed is:

1. A liquid crystal display panel, comprising a non-display area and a display area, wherein the non-display area is disposed around a periphery of the display area; wherein the non-display area is provided with a system on chip, and the display area comprises at least two display sub-areas, and each of the display sub-areas is provided with a corresponding timing controller; the system on chip is electrically connected to each of the timing controllers, and sends edge video data displayed in an edge area of an adjacent display sub-area to each of the timing controllers, and the timing controller receives and processes the edge video data; wherein the adjacent display sub-area is a display sub-area next to the display sub-area corresponding to the timing controller, and the edge area of the adjacent display sub-area is a partial area of the adjacent display sub-area next to the display sub-area corresponding to the timing controller, wherein a frame period of the liquid crystal display panel comprises a vertical active video interval and a vertical blanking interval, wherein the vertical active video interval is a scanning time between a time point when an electron gun starts scanning a frame of image and a time point when the electron gun accomplishes scanning the frame of image, and the vertical blanking interval is a preparation time between the time point when the electron gun accomplishes scanning the frame of image and a time point when the electron gun starts scanning a next frame of image; the system on chip transmits the edge video data to the timing controllers via a V-by-one interface in the vertical blanking interval.

2. The liquid crystal display panel according to claim 1, wherein the display area at least comprises a first display sub-area and a second display sub-area, and the first display sub-area is provided with a first timing controller, and the second display sub-area is provided with a second timing controller; wherein the first display sub-area is disposed next to the second display sub-area, and the system on chip is electrically connected to the first timing controller and the second timing controller.

3. The liquid crystal display panel according to claim 1, wherein the system on chip comprises a data reading circuit, a data recombining circuit and a data transmitting circuit;

the data reading circuit reads the edge video data stored in the system on chip;

the data recombining circuit is electrically connected to the data reading circuit, and recombines the edge video data read by the data reading circuit to obtain recombined edge video data, and the recombined edge video data possesses a data format required by the V-by-one interface; and the data transmitting circuit is electrically connected to the data recombining circuit, and transmits the recombined edge video data to the timing controller via the V-by-one interface.

4. The liquid crystal display panel according to claim 3, wherein the timing controller comprises a data receiving circuit, a data decoding circuit, a data importing circuit and an importing algorithm circuit;

the data receiving circuit is configured to receive the recombined edge video data transmitted by the system on chip via the V-by-one interface;

the data decoding circuit is electrically connected to the data receiving circuit, and decodes the recombined edge video data received by the data receiving circuit to obtain decoded edge video data, and the decoded edge video data possesses a data format required by the timing controller;

the data importing circuit is electrically connected to the data decoding circuit, and transmits the decoded edge video data to the importing algorithm circuit; and the importing algorithm circuit is electrically connected to the data importing circuit, and receives the decoded edge video data transmitted by the data importing circuit, and processes the decoded edge video data according to a preset image processing algorithm.

5. The liquid crystal display panel according to claim 4, wherein the preset image processing algorithm comprises a color shift compensation algorithm and/or a visual compensation algorithm.

6. The liquid crystal display panel according to claim 1, wherein the system on chip further transmits entire video data displayed in the display sub-area corresponding to the timing controller to each of the timing controllers, and the timing controller further receives and processes the entire video data.

7. The liquid crystal display panel according to claim 6, wherein the system on chip transmits the entire video data to the timing controller through the V-by-one interface in the vertical active video interval.

8. The liquid crystal display panel according to claim 1, wherein the vertical blanking interval comprises a vertical front porch, a vertical synchronization interval and a vertical back porch; wherein the vertical synchronization interval is a duration of a vertical synchronization signal, and the vertical synchronization signal controls the electron gun to scan the next frame of image, and the vertical front porch is a time between the time point when the electron gun accomplishes scanning the frame of image and a time point of starting the vertical synchronization signal, and the vertical back porch is a time between a time point of finishing the vertical synchronization signal to the time point when the electron gun starts scanning the next frame of image.

9. A liquid crystal display device, comprising a liquid crystal display panel, wherein the liquid crystal display panel comprises a non-display area and a display area, wherein the non-display area is disposed around a periphery of the display area; wherein the non-display area is provided with a system on chip, and the display area comprises at least two display sub-areas, and each of the display sub-areas is provided with a corresponding timing controller; the system on chip is electrically connected to each of the timing controllers, and sends edge video data displayed in an edge area of an adjacent display sub-area to each of the timing controllers, and the timing controller receives and processes the edge video data; wherein the adjacent display sub-area is a display sub-area next to the display sub-area corresponding to the timing controller, and the edge area of the adjacent display sub-area is a partial area of the adjacent display sub-area next to the display sub-area corresponding to the timing controller, wherein a frame period of the liquid crystal display panel comprises a vertical active video interval and a vertical blanking interval, wherein the vertical active video interval is a scanning time between a time point when an electron gun starts scanning a frame of image and a time point when the electron gun accomplishes scanning the frame of image, and the vertical blanking interval is a preparation time between the time point when the electron gun accomplishes scanning the frame of image and a time point when the electron gun starts scanning a next frame of image; the system on chip transmits the edge video data to the timing controllers via a V-by-one interface in the vertical blanking interval.

10. The liquid crystal display device according to claim 9, wherein the display area at least comprises a first display sub-area and a second display sub-area, and the first display sub-area is provided with a first timing controller, and the second display sub-area is provided with a second timing controller; wherein the first display sub-area is disposed next to the second display sub-area, and the system on chip is electrically connected to the first timing controller and the second timing controller.

11. The liquid crystal display device according to claim 9, wherein the system on chip comprises a data reading circuit, a data recombining circuit and a data transmitting circuit;

the data reading circuit reads the edge video data stored in the system on chip;

the data recombining circuit is electrically connected to the data reading circuit, and recombines the edge video data read by the data reading circuit to obtain recombined edge video data, and the recombined edge video data possesses a data format required by the V-by-one interface; and the data transmitting circuit is electrically connected to the data recombining circuit, and transmits the recombined edge video data to the timing controller via the V-by-one interface.

12. The liquid crystal display device according to claim 11, wherein the timing controller comprises a data receiving circuit, a data decoding circuit, a data importing circuit and an importing algorithm circuit;

the data receiving circuit is configured to receive the recombined edge video data transmitted by the system on chip via the V-by-one interface;

the data decoding circuit is electrically connected to the data receiving circuit, and decodes the recombined edge video data received by the data receiving circuit to obtain decoded edge video data, and the decoded edge video data possesses a data format required by the timing controller;

the data importing circuit is electrically connected to the data decoding circuit, and transmits the decoded edge video data to the importing algorithm circuit; and the importing algorithm circuit is electrically connected to the data importing circuit, and receives the decoded edge video data transmitted by the data importing circuit, and processes the decoded edge video data according to a preset image processing algorithm.

13. The liquid crystal display device according to claim 12, wherein the preset image processing algorithm comprises a color shift compensation algorithm and/or a visual compensation algorithm.

14. The liquid crystal display device according to claim 9, wherein the system on chip further transmits entire video data displayed in the display sub-area corresponding to the timing controller to each of the timing controllers, and the timing controller further receives and processes the entire video data.

15. The liquid crystal display device according to claim 14, wherein the system on chip transmits the entire video data to the timing controller through the V-by-one interface in the vertical active video interval.

16. The liquid crystal display device according to claim 9, wherein the vertical blanking interval comprises a vertical front porch, a vertical synchronization interval and a vertical back porch; wherein the vertical synchronization interval is a duration of a vertical synchronization signal, and the vertical synchronization signal controls the electron gun to scan the next frame of image, and the vertical front porch is a time between the time point when the electron gun accomplishes scanning the frame of image and a time point of starting the vertical synchronization signal, and the vertical back porch is a time between a time point of finishing the vertical synchronization signal to the time point when the electron gun starts scanning the next frame of image.

* * * * *